US011554286B2

(12) United States Patent
Wright, Sr.

(10) Patent No.: US 11,554,286 B2
(45) Date of Patent: Jan. 17, 2023

(54) SIT UP PUSH UP DEVICE

(71) Applicant: Ronald Sylvester Wright, Sr., Richmond, VA (US)

(72) Inventor: Ronald Sylvester Wright, Sr., Richmond, VA (US)

( * ) Notice: Subject to any disclaimer, the term of this patent is extended or adjusted under 35 U.S.C. 154(b) by 68 days.

(21) Appl. No.: 17/078,537

(22) Filed: Oct. 23, 2020

(65) Prior Publication Data

US 2021/0121731 A1 Apr. 29, 2021

Related U.S. Application Data

(60) Provisional application No. 62/924,766, filed on Oct. 23, 2019.

(51) Int. Cl.

| | |
|---|---|
| ***A63B 21/00*** | (2006.01) |
| ***A63B 21/16*** | (2006.01) |
| ***A63B 23/12*** | (2006.01) |
| ***A63B 23/02*** | (2006.01) |

(52) U.S. Cl.

CPC ..... *A63B 21/4034* (2015.10); *A63B 21/169* (2015.10); *A63B 21/4015* (2015.10); *A63B 23/0211* (2013.01); *A63B 23/1236* (2013.01); *A63B 21/00047* (2013.01)

(58) Field of Classification Search

CPC ... A63B 21/169; A63B 21/4034; A63B 21/16; A63B 21/1618; A63B 21/1627; A63B 21/1636; A63B 21/1645; A63B 21/1654; A63B 21/1663; A63B 21/0411; A63B 21/0413; A63B 21/0415; A63B 21/4033; A63B 21/4035; A63B 21/00047; A63B 23/1236; A63B 23/0205; A63B 23/0211; A63B 23/0233; A63B 23/1209; A63B 23/1218

See application file for complete search history.

(56) References Cited

U.S. PATENT DOCUMENTS

| | | | | |
|---|---|---|---|---|
| 4,509,748 | A | 4/1985 | Bezak | |
| 6,322,485 | B1 | 11/2001 | Marrero | |
| 7,207,932 | B1 | 4/2007 | Dean | |
| 7,367,928 | B2 | 5/2008 | Storch | |
| 8,016,726 | B2 | 9/2011 | Abiemo et al. | |
| 9,199,111 | B2 * | 12/2015 | Flores | A63B 17/00 |
| 9,498,664 | B2 * | 11/2016 | Lorentz, II | A63B 21/0552 |
| 10,589,149 | B2 * | 3/2020 | Tellam | A63B 69/0062 |
| 2007/0161478 | A1 * | 7/2007 | Yu | A61H 1/0218 482/145 |
| 2014/0148315 | A1 | 5/2014 | Thompson | |
| 2016/0220862 | A1 * | 8/2016 | Johnson | A63B 21/068 |

FOREIGN PATENT DOCUMENTS

WO 2013097033 A1 7/2013

* cited by examiner

*Primary Examiner* — Megan Anderson

(74) *Attorney, Agent, or Firm* — Bernard G. Pike; Pike IP Law

(57) ABSTRACT

An exercise device that is specifically configured for use by persons having diabetic neuropathy or other foot pain issues is described. The exercise device comprises footrests for the left and right feet of the user that elevate the feet and support them in the ankle region to assist in the performance of exercises that may otherwise be too painful for the user to perform.

12 Claims, 2 Drawing Sheets

SIT UP PUSH UP DEVICE

FIELD OF THE INVENTION

The present invention relates generally to exercise systems, and more particularly to an exercise device that can be used to perform sit-up and push-up exercises.

BACKGROUND OF THE INVENTION

Exercise and physical fitness are more emphasized than ever. With more work being done from a desk than in previous generations, exercise devices and machines have become more essential to many. Classic exercises, known to anyone who had a Physical Education class in school, are push-ups and sit-ups. These exercises build and tone muscles, while raising the participant's heart rate. These exercises may be easily accomplished in a school gym, but can be harder when one is alone, at home, or at work. Sit-up exercises can be more easily done when someone else is holding the participant's feet down, as they sit up. While push-up exercises can be done alone, they are made nearly impossible when the participant does not have strong toes to rely on or has severe toe or heel pain, either due to old age, lack of previous fitness routines, or a medical condition such as diabetes. People with diabetes require exercise to improve their condition but the side effects of the disease can make exercise difficult if not too painful to perform. Various exercise devices to aid sit-ups are well known in the art, allowing them to be done independently. Additionally, various exercise devices to aid push-ups are well known in the art, usually only providing a comfortable surface for the push-ups, or supporting the hands of the participant.

Accordingly, there exists a need for an exercise device that can be used to aid the participant in performing sit ups independently and perform push-ups and sit-ups while his feet are elevated, and pressure is taken off his toes.

SUMMARY

An exercise device to assist with the performance of sit-ups and push-ups is described. The exercise device may be of particular use for people suffering from diabetic neuropathy. Embodiments of an exercise device may comprise two footrests, including a left footrest for a left foot of a user and a right footrest for a right foot of the user. The footrests may be supported at a sufficient height so that a user performing a push-up with their feet in the footrests does not experience pressure and discomfort on their toes. This allows people afflicted with diabetic neuropathy to perform exercises that will help them manage the disease that they otherwise may not be able to perform.

An embodiment of the exercise device may comprise at least one base connected to at least one of the left footrest, the right foot rest, or both the left footrest and the right footrest. The base plate and at least one of the right footrest and the left foot rest define a foot receiving aperture 3R or 3L. A foot of the user may be inserted into the foot receiving aperture 3R or 3L from either the top or the bottom for performing either push-ups or sit ups.

Embodiments of the exercise device may comprise at least one support, wherein the support maintains at least one of the left footrest, the right foot rest, and both the left footrest and the right footrest at a height such that the foot support height is greater than the ankle support distance of the user while the user is in a push up position. This allows a user to perform push-up exercises without their toes or the toes of their shoes resting on the ground.

The base may be configured to be connected to a wall such as by screws or other fastening device. The base may be connected to the wall at such that the footrests are at the desired height for the user to perform the exercises as described.

The footrests may be adjustable in either the vertical or horizontal direction by use of positioning plates attached to the base. The positioning plates may be moveably connected to the base plate. The positioning plates may be removed and repositioned such as by screws, pegs and holes, hook and loop connectors, pins or other retaining mechanism. In other embodiments, the positioning plates may be slid on a track and secured in a new location, for example. The base plate may comprise two positioning plates, a left positioning plate and a right positioning plate, the left positioning plate is connected to the left footrest and the right positioning plate is connected to the right footrest.

Since the foot may rest on footrests, each of the left footrest and the right footrest may comprise footrest padding. The padding may be a foam or rubber padding and, preferably, is slip resistant. The left footrest and the right footrest may also be U-shaped or other shape that conforms to the shape of the ankle and foot of a user.

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are Intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

BRIEF DESCRIPTION OF THE DRAWING

In the drawings, like elements are depicted by like references numerals. The drawings are briefly described as follows.

DETAILED DESCRIPTION OF THE INVENTION

Figure 1:
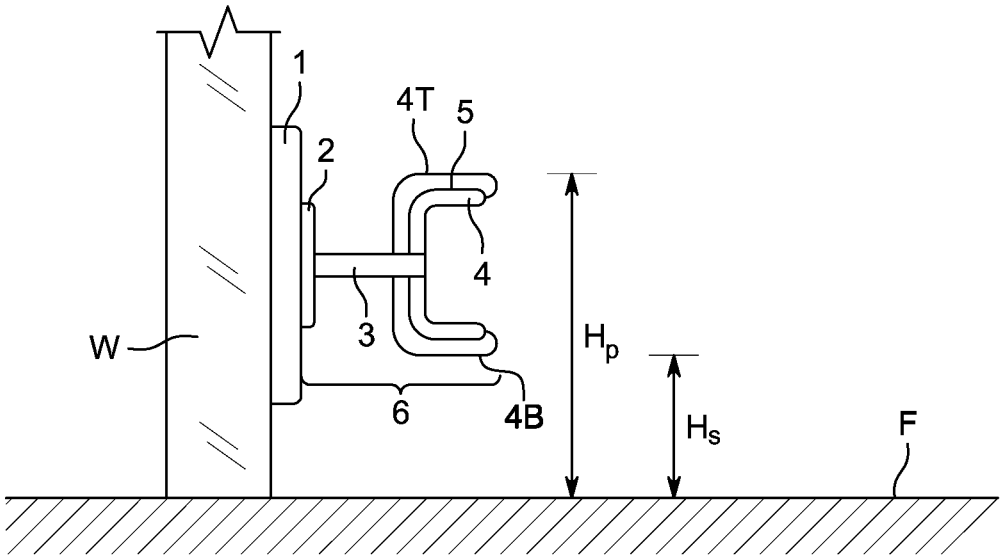
FIG. 1 is a perspective view of the device from the side of the device.

An exercise assistance device is needed to assist people perform exercises. Especially, people that have pain in their feet or toes. An exercise device may assist with performing exercises that may be difficult, painful, or even impossible to perform without assistance of the device. In one embodiment, the exercise device is a sit-up/push-up device. The sit-up/push-up device allows a person, such as a diabetic person with diabetic neuropathy, to perform exercises that would otherwise be too painful.

Diabetic neuropathy is a type of nerve damage that can occur in diabetes patients. High blood sugar (glucose) associated with diabetes can injure nerves throughout your body. Diabetic neuropathy most often damages nerves in legs and feet.

Depending on the affected nerves, diabetic neuropathy symptoms often results in pain and numbness in your legs and feet as well as other symptoms. For some, diabetic neuropathy can be quite painful and disabling.

Diabetic neuropathy is a serious diabetes complication that may affect as many as fifty percent of people with diabetes. But you can often prevent diabetic neuropathy or slow its progress with consistent blood sugar management and a healthy lifestyle. However, a healthy lifestyle may be difficult with more severed cases of diabetic neuropathy.

Embodiments of the sit-up/push-up device support the feet above the floor to prevent or reduce the pressure on the foot by contact with the floor. In one embodiment, the sit-up/push-up device prevents pressure on the heels of the feet while performing sit ups. Sit ups are a well know exercise that are performed while sitting or laying on the floor face up. In another embodiment, the sit-up/push-up device prevents or reduces pressure on the toes of the feet while performing push-ups. Push-ups are a well know exercise that are performed while supporting yourself on your arms or laying on the floor down up. In another embodiment, the sit-up/push-up device may be configured to support the feet above the floor to prevent the pressure on the heels of the feet while performing sit ups and prevent pressure on the toes of the feet while performing push-ups.

In an embodiment, a sit-up/push-up device comprises a footrest that is supported over a floor or other exercise surface (hereinafter, "floor"). The person that is exercising may rest their foot behind the footrest so that the ankle and foot are supported on the footrest such that, in the push-up position, the toes are supported by the ankles to reduce or prevent pressure on the toes.

In one embodiment, the sit-up/push-up device is attached to a vertical surface such as, but not limited to, a wall to support the footrest over the floor or other exercise surface. In such embodiments, the wall or a component of the sit-up/push-up device define at least one foot receiving apertures. In one embodiment, the wall or a component of the sit-up/push-up device defines two foot receiving apertures 3R and 3L, one for the left foot and the other for the right foot.

The foot may be received from the top with the toes pointing down (for performing push-ups) and with the toes elevated from the floor. The foot may also be received through the bottom with the toes pointing upward (for performing sit-ups) and the heels may be elevated from the floor. The aperture defining portions may be lined with a resilient cushioned material to assist in retaining the foot within the foot receiving apertures.

With reference now to the drawings, FIG. 1 shows an embodiment of the sit-up/push-up device in elevation view as viewed from the side, down the length of the device. In FIG. 1, the embodiment of the device is comprised of an optional base member 1, a positioning plates 2, support members 3, footrests 4, and footrest padding 5.

Figure 4:
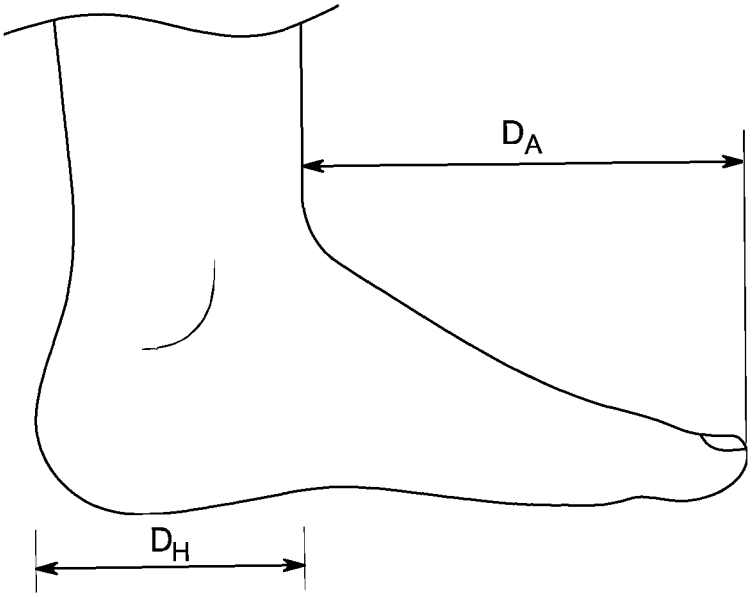
FIG. 4 is depicts the dimensions of a user's foot.

In the embodiment of FIG. 1, the base member 1 may be 8 inches in height and consists of a durable metal material, for example. The base member may be connected to a support such as a wall W or other stand that supports the footrest a position wherein the user's foot resting on the top 4T of the footrest with the toes pointing toward the floor is a foot support height $H_P$ so that the toes of the user or the user's shoes are supported above the floor F. The sit-up/push-up device may be positioned on the wall or other support by measuring the ankle support distance $D_A$ (See FIG. 4) from the front of the ankle to the tip of the toe of the person or the toe of their shoe and ensuring that the height $H_P$ is greater than the ankle support distance $D_A$. Similarly, the sit-up height $H_S$ is greater than the distance from the front of the ankle to the back of the heal of the user or the heel of the user's shoe $D_H$ to support the heel above the floor F during sit-up exercises.

The positioning plate 2 is connected to the base member, the positioning plate 2 may be 3 inches in height, or other desired height, and may consist of a durable metal material, other structurally supportive material such as a plastic or combination thereof. The support member 3 is connected to the positioning plate 2, the support member 3 may comprise a durable metal, plastic material or combination thereof, for example. The U-shaped footrest 4 is connected to the support member 3, the support member 3 may be connected at the bottom of the U to the U-shaped footrest 4 as shown. In the depicted embodiment, the U-shaped footrest 4 has a height of 4 inches but any size that comfortably supports the feet of the user may be used. The footrest padding 5 may connected to the foot supporting surface of the U-shaped footrest 4, for example, being connected on the outside of the U to the U-shaped footrest 4. The aperture defined between the positioning plate 2 and the U-shaped footrest 4 is large enough to fit an adult foot and is a foot-receiving aperture.

In another embodiment, the left footrest and the right support rest may be independent parts that are independently connected to the wall or other support in the correct position as described herein. In such an embodiment, each foot rest 5 will be connected to a separate base plate. For example, the left footrest will be connected to a left base plate and the right foot rest will be connected to a right base plate.

Figure 2:
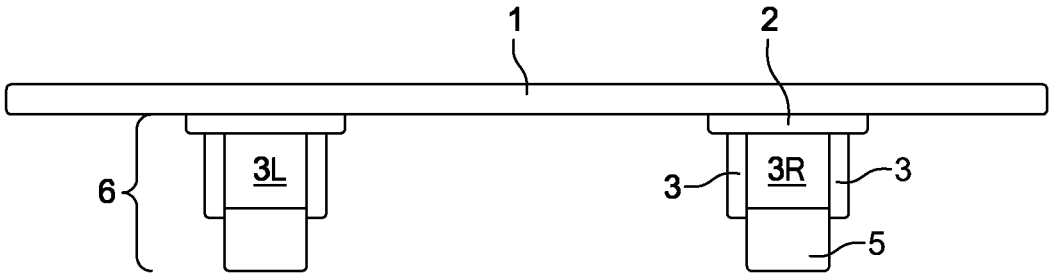
FIG. 2 is a perspective view of the device from of FIG. 1.

FIG. 2 shows a plan view of the embodiment of the sit-up/push-up device of FIG. 1, when viewed from above, down the height of the device. This view of the device, FIG. 2, shows two positioned units 6, as well as two support members 3 on each positioned unit 6, which were unable to be shown from the view presented in FIG. 1. In FIG. 2, the base member 1 has a length of 36 inches. The base member 1 is connected to the positioning plate 2, the positioning plate has a length of 7 inches. The positioning plate 2 is connected to two support members 3, the support members may each have a length of 1 inch and set apart by about 6 inches from each other, for example. The U-shaped footrest 4 is connected to both support members 3, but cannot be viewed from above, because the U-shaped footrest 4 is covered by the footrest padding 5. The U-shaped footrest 4 and the footrest padding 5 may be about 6 inches in length.

Figure 3:
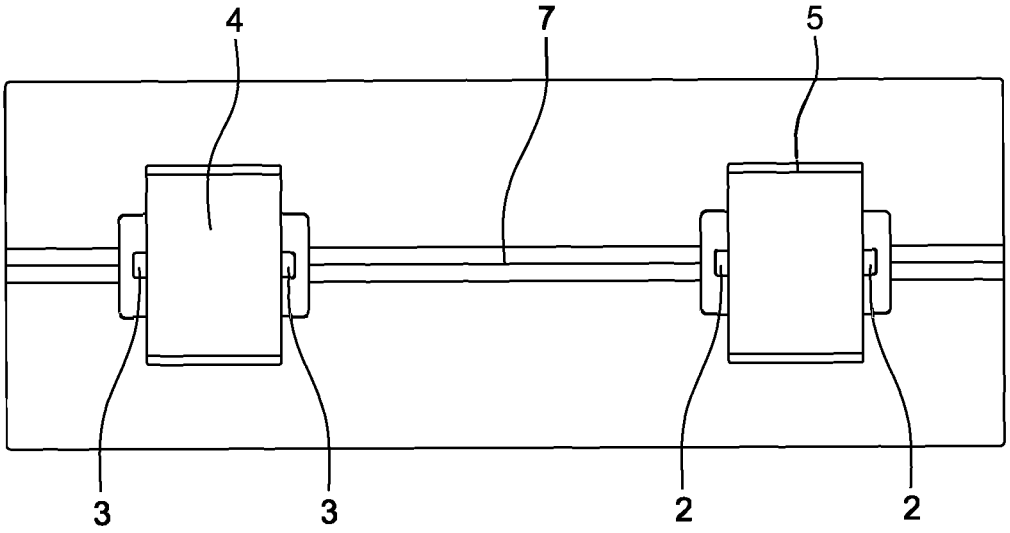
FIG. 3 is a perspective view of the device from the front of the device of FIG. 1.

FIG. 3 shows the embodiment of the sit-up/push-up device of FIG. 1, when viewed from front. This view displays a track 7 within the base member 1, which could not be viewed from other angles. The track 7 within the base member defines a small aperture, which is connected to the positioning plate 2, allowing each positioned unit 6 to be moved to a comfortable position for the participant to be able to perform his exercises. The track 7 may have a length of about 24 inches, for example. The positioning plates may be held in place by a retaining device such as an bolt, set screw, latch, spring operated pin, or other locking mechanism.

Additional embodiments of the device not depicted in the drawings include the same device with a base member having 2 holes. The holes can be used to mount the device to a wall or door. Another embodiment of the device includes a footrest that is not U-shaped, but could be saddle shaped, round shaped, or cylinder shaped. Another embodiment of the device does not have the positioning plate, the support members are directly connected to the base member, and the foot-receiving aperture is defined by the base member instead of the positioning plate.

The embodiments of the described methods and exercise device are not limited to the embodiments, components, method steps, and materials disclosed herein as such components, process steps, and materials may vary. Moreover, the terminology employed herein is used to describing exemplary embodiments only and the terminology is not intended to be limiting since the scope of the various embodiments of the present invention will be limited only by the appended claims and equivalents thereof.

Therefore, while embodiments of the invention are described with reference to exemplary embodiments, those skilled in the art will understand that variations and modifications can be affected within the scope of the invention as defined in the appended claims. Accordingly, the scope of the various embodiments of the present invention should not be limited to the above discussed embodiments and should only be defined by the following claims and all equivalents.

The invention claimed is:

1. An exercise device comprising:

two footrests including a left footrest for a left foot and a right footrest for a right foot, wherein the left and right footrests are U-shaped footrests;

a base connected to at least one of the left footrest, the right footrest, and both the left footrest and the right footrest, two left support members connected between the left footrest and the base and two right support members connected between the right footrest and the base, wherein the left and right support members maintain at least one of the left footrest, the right footrest, and both the left footrest and the right footrest at a height such that a foot support height is greater than a ankle support distance of a user while the user is in a push up position and wherein the base, the the base, the two left support members, and the left footrest define a left foot receiving aperture.

2. The exercise device of claim 1, wherein the base comprises a positioning plate.

3. The exercise device of claim 2, wherein the positioning plate is moveably connected to the base.

4. The exercise device of claim 3, wherein the base-plate comprises two positioning plates, a left positioning plate and a right positioning plate, the left positioning plate is connected to the left footrest and the right positioning plate is connected to the right footrest.

5. The exercise device of claim 4, wherein the base comprises a track which allows the left positioning plate and right positioning plate to be moved along the track.

6. The exercise device of claim 1, wherein both the left footrest and the right footrest are connected to the base.

7. The exercise device of claim 6, wherein the base is configured to be connected to a wall.

8. The exercise device of claim 1, wherein each of the left footrest and the right footrest comprise footrest padding on the outside of the U of the U-shaped footrest.

9. The exercise device of claim 8, wherein the footrest padding is made from rubber or foam.

10. The exercise device of claim 1, wherein the base has a least two holes configured for mounting the exercise devise to a wall.

11. The exercise device of claim 1, wherein the left foot receiving aperture receives the left foot and the right foot receiving aperture receives the right foot of the user when using the exercise device.

12. The exercise device of claim 1, wherein an opened end of the respective U-shaped footrest faces horizontally.

* * * * *